US011730680B2

(12) United States Patent
Rees et al.

(10) Patent No.: US 11,730,680 B2
(45) **Date of Patent: *Aug. 22, 2023**

(54) BABY BOTTLE WITH FLEXIBLE NIPPLE REGIONS

(71) Applicant: Mayborn (UK) Limited, New Castle Upon Tyne (GB)

(72) Inventors: Arnold Rees, Newcastle Upon Tyne (GB); Ian Webb, London (GB); Mark Armstrong, Wales (GB); Tom Cotton, London (GB)

(73) Assignee: Mayborn (UK) Limited, New Castle Upon Tyne (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/562,519

(22) Filed: Dec. 27, 2021

(65) Prior Publication Data

US 2022/0192928 A1 Jun. 23, 2022

Related U.S. Application Data

(63) Continuation of application No. 17/208,932, filed on Mar. 22, 2021, now Pat. No. 11,207,244, which is a (Continued)

(30) Foreign Application Priority Data

Jun. 29, 2004 (GB) ..... 200414560
Feb. 8, 2005 (GB) ..... 200502599

(51) Int. Cl.
*A61J 11/00* (2006.01)
*A61J 11/02* (2006.01)
(Continued)

(52) U.S. Cl.
CPC ..... *A61J 11/006* (2013.01); *A61J 11/0065* (2013.01); *A61J 11/02* (2013.01);
(Continued)

(58) Field of Classification Search
CPC ... A61J 9/04; A61J 11/02; A61J 11/002; A61J 11/0035; A61J 11/005; A61J 11/006;
(Continued)

(56) References Cited

U.S. PATENT DOCUMENTS 380,835 A 4/1888 Ware
1,146,639 A 7/1915 Miller
(Continued)

FOREIGN PATENT DOCUMENTS

AT 006721 3/2004
AT 007456 4/2005
(Continued)

OTHER PUBLICATIONS

US 4,603,150, 12/22/2010, Usui (withdrawn).
(Continued)

*Primary Examiner* — Andrew T Kirsch
(74) *Attorney, Agent, or Firm* — Fish & Richardson P.C.

(57) ABSTRACT

According to a first embodiment, a feeding bottle comprises a vessel, collar, and nipple. The nipple comprises a base portion, a teat portion, an areola portion allowing movement of the teat portion towards and away from the base portion. According to a second embodiment, a feeding bottle comprises a vessel, collar, nipple and handle portion removeably secured to the vessel by the collar. The invention includes a flexible region or regions to provide a more natural feeding by closely mimicking the human breast.

30 Claims, 6 Drawing Sheets

Related U.S. Application Data continuation of application No. 14/551,783, filed on Nov. 24, 2014, now Pat. No. 10,952,930, which is a continuation of application No. 13/364,557, filed on Feb. 2, 2012, now Pat. No. 8,910,810, which is a continuation of application No. 11/630,864, filed as application No. PCT/GB2005/002532 on Jun. 29, 2005, now Pat. No. 8,181,800.

(51) Int. Cl.
*A61J 11/04* (2006.01)
*A61J 17/00* (2006.01)

(52) U.S. Cl.
CPC ..... *A61J 11/04* (2013.01); *A61J 11/045* (2013.01); *A61J 17/001* (2015.05)

(58) Field of Classification Search
CPC ..... A61J 11/0065; A61J 11/045; A61J 11/04; A61J 9/00; A61J 17/001; A47G 19/2272
See application file for complete search history.

(56) References Cited

U.S. PATENT DOCUMENTS 1,202,740 A 10/1916 Kraft
1,510,571 A 10/1924 Ware
1,672,734 A 6/1928 Reilly
1,797,433 A 3/1931 McCrea
1,902,433 A 3/1933 Brown
1,919,537 A 7/1933 Stock, Jr.
1,998,646 A 4/1935 Yager
1,999,581 A 4/1935 Yager
2,039,373 A 5/1936 Wittmann
2,093,730 A 9/1937 Kurkjian
2,174,361 A 9/1939 Condon
2,394,722 A 2/1946 Sloane
2,517,457 A 8/1950 Allen
2,588,069 A 3/1952 Allen
2,610,755 A 9/1952 Gits
2,616,581 A 11/1952 Madsen et al.
2,688,326 A 9/1954 Lerman
2,803,250 A 8/1957 Barr
2,956,702 A 10/1960 Ransom
3,082,770 A 3/1963 Straub
3,097,757 A 7/1963 Searer
3,113,569 A 12/1963 Barr
2,426,927 A 9/1964 Ganson
3,232,466 A 2/1966 Fuad
3,276,884 A 10/1966 Barnby
3,493,139 A 2/1970 Faddoul et al.
3,495,993 A 2/1970 Barr
3,567,060 A 3/1971 Ballin
3,704,803 A 12/1972 Ponder
3,790,017 A 2/1974 Fitzpatrick
2,812,092 A 11/1974 Witz
3,946,888 A 3/1976 Tonkin
3,990,596 A 11/1976 Hoffman
4,193,588 A 3/1980 Doneaux
4,238,040 A 12/1980 Fitzpatrick
4,339,046 A 7/1982 Coen
4,586,621 A 5/1986 Dahan
4,613,050 A 9/1986 Atkin et al.
4,685,577 A 8/1987 Chen et al.
4,834,099 A 5/1989 Schrooten
4,993,568 A 2/1991 Morifuji et al.
5,101,991 A 4/1992 Monifuji et al.
5,295,597 A 3/1994 Green
5,431,290 A 7/1995 Vintiguerra
5,474,028 A 12/1995 Larson et al.
5,544,766 A 8/1996 Dunn et al.
5,593,052 A 1/1997 McGee
D384,748 S 10/1997 Dunn
5,673,806 A 10/1997 Busnel
5,678,710 A 10/1997 Shen
5,699,921 A 12/1997 Rodriguez
5,706,973 A 1/1998 Robbins, III et al.
5,784,999 A 7/1998 Larson et al.
D404,138 S 1/1999 Meyers
5,862,927 A 1/1999 Tebeau
D405,530 S 2/1999 Manganiello
5,881,893 A 3/1999 Manganielio
D412,582 S 8/1999 Morano
6,003,698 A 12/1999 Morano
D421,306 S 2/2000 Meyers et al.
6,032,810 A 3/2000 Meyers et al.
D425,994 S 5/2000 Hakim
6,073,788 A 6/2000 Stroud
6,092,680 A 7/2000 Pillado
6,161,710 A 12/2000 Dieringer
6,176,380 B1 1/2001 Glories
D441,870 S 5/2001 Randolph
D444,239 S 6/2001 Katsuyoshi
6,241,110 B1 6/2001 Hakim
6,270,519 B1 8/2001 Botts
6,321,931 B1 11/2001 Hakim et al.
D454,642 S 3/2002 Hakim
6,357,620 B1 3/2002 Hakim
D459,815 S 7/2002 Pastucha
6,422,415 B1 7/2002 Manganielio
D463,567 S 9/2002 Morano
D464,434 S 10/2002 Morano
D465,028 S 10/2002 Renz
6,601,720 B2 2/2003 Meyers et al.
D479,606 S 9/2003 Randolph
6,645,228 B2 11/2003 Renz
D486,579 S 2/2004 Dunn
D488,560 S 4/2004 Renz
6,745,912 B2 6/2004 Uehara et al.
D498,849 S 11/2004 Randolph
6,872,116 B1 3/2005 Dunnum et al.
6,883,672 B2 4/2005 Dunn et al.
D504,723 S 5/2005 Randolph
D504,724 S 5/2005 Randolph
D504,725 S 5/2005 Randolph
6,959,827 B2 11/2005 Morano et al.
6,981,962 B1 1/2006 Lenkersdorf
6,984,688 B2 1/2006 Gu
6,994,225 B2 2/2006 Hakim
D520,142 S 5/2006 Mallet
7,108,676 B2 9/2006 Loging
7,122,045 B2 10/2006 Randolph et al.
7,134,564 B2 11/2006 Verbovszky
7,150,370 B2 12/2006 Pyun
7,185,775 B1 3/2007 Decal
D539,910 S 4/2007 Ordonez
7,204,386 B2 4/2007 Hakim
7,210,591 B2 5/2007 Goldman et al.
D547,874 S 7/2007 Horie
7,243,814 B2 7/2007 Hakim
7,252,676 B1 8/2007 Williams
7,320,678 B2 1/2008 Ruth et al.
7,395,941 B2 7/2008 Hong
7,481,324 B2 1/2009 Almonte
7,549,548 B2 6/2009 Kraus et al.
D599,028 S 8/2009 Schofield
D620,125 S 7/2010 Rees et al.
D626,246 S 10/2010 Rees et al.
7,828,821 B2 11/2010 Renz
8,708,174 B2 4/2014 Itzek
10,251,817 B2 4/2019 Roehrig
11,207,244 B2 12/2021 Rees et al.
2002/0030029 A1 3/2002 Hakim
2002/0033399 A1 3/2002 Manganiell et al.
2002/0063103 A1 5/2002 Kiernan
2003/0032984 A1 2/2003 Hakim
2003/0089676 A1 5/2003 Uehara et al.
2003/0093120 A1 5/2003 Renz
2003/0106872 A1 6/2003 Lin
2003/0141268 A1 7/2003 Kerns et al.
2004/0026351 A1 2/2004 Dunn et al.
2004/0035815 A1 2/2004 Webb et al.
2004/0124168 A1 7/2004 Silver
2004/0188373 A1 9/2004 Lewis et al.

(56) References Cited

U.S. PATENT DOCUMENTS

| | | | |
|---|---|---|---|
| 2004/0220618 | A1 | 11/2004 | Roehrig |
| 2004/0226906 | A1 | 11/2004 | Peterson |
| 2004/0256345 | A1 | 12/2004 | Lundquist |
| 2005/0035078 | A1 | 2/2005 | Lieberman et al. |
| 2005/0056611 | A1 | 3/2005 | Hakim |
| 2005/0184022 | A1 | 8/2005 | Dunn et al. |
| 2005/0224444 | A1 | 10/2005 | Akihiro |
| 2005/0247658 | A1 | 11/2005 | Renz |
| 2005/0247719 | A1 | 11/2005 | Loging |
| 2005/0252875 | A1 | 11/2005 | Shen et al. |
| 2005/0258123 | A1 | 11/2005 | Silver |
| 2005/0277987 | A1 | 12/2005 | Randolph et al. |
| 2005/0288712 | A9 | 12/2005 | Hakim |
| 2006/0011571 | A1 | 1/2006 | Silver |
| 2006/0273059 | A1 | 12/2006 | Mendenhall et al. |
| 2006/0278597 | A1 | 12/2006 | Daugherty et al. |
| 2007/0021782 | A1 | 1/2007 | Inoue et al. |
| 2007/0045214 | A1 | 3/2007 | Jennings |
| 2007/0095778 | A1 | 5/2007 | Catton |
| 2007/0102388 | A1 | 5/2007 | Lewis et al. |
| 2007/0131637 | A1 | 6/2007 | Tamura et al. |
| 2007/0138121 | A1 | 6/2007 | Sterling et al. |
| 2007/0138709 | A1 | 6/2007 | Sabree et al. |
| 2007/0163983 | A1 | 7/2007 | Hsu |
| 2007/0187419 | A1 | 8/2007 | Hakim |
| 2007/0221604 | A1 | 9/2007 | Hakim |
| 2007/0272645 | A1 | 11/2007 | Ito et al. |
| 2007/0278172 | A1 | 12/2007 | Hakim |
| 2007/0283666 | A1 | 12/2007 | Py et al. |
| 2008/0128379 | A1 | 6/2008 | Hen |
| 2008/0173654 | A1 | 7/2008 | Hakim |
| 2008/0188894 | A1 | 8/2008 | Hakim |
| 2008/0210655 | A1 | 9/2008 | Rees et al. |
| 2008/0314776 | A1 | 12/2008 | Cooke |
| 2009/0005811 | A1 | 1/2009 | DuChesne et al. |
| 2009/0039046 | A1 | 2/2009 | Marr et al. |
| 2010/0102019 | A1 | 4/2010 | Randolph et al. |
| 2015/0083685 | A1 | 3/2015 | Rees et al. |
| 2021/0244622 | A1 | 8/2021 | Rees et al. |

FOREIGN PATENT DOCUMENTS

| | | |
|---|---|---|
| BR | 9604688 | 1/1998 |
| CH | 118512 | 1/1927 |
| CH | 467068 | 1/1969 |
| CH | 497894 | 10/1970 |
| CN | 86204477 | 9/1987 |
| CN | 2150869 | 12/1993 |
| CN | 2533853 | 2/2003 |
| CN | 2557137 | 6/2003 |
| CN | 1461636 | 12/2003 |
| CN | 207816326 | 3/2018 |
| DE | 860843 | 12/1952 |
| DE | 7736290 | 3/1978 |
| DE | 8131025 | 4/1983 |
| DE | 19716535 | 11/1997 |
| DE | 19849271 | 4/2000 |
| DE | 20210121 | 10/2002 |
| DE | 202004005564 | 6/2004 |
| EP | 0151862 | 8/1985 |
| EP | 0536344 | 10/1997 |
| EP | 0845971 | 10/2001 |
| EP | 1297814 | 4/2003 |
| EP | 1310230 | 5/2003 |
| FR | 2205817 | 5/1974 |
| GB | 191204210 | 6/1912 |
| GB | 437822 | 11/1935 |
| GB | 621245 | 4/1949 |
| GB | 639628 | 7/1950 |
| GB | 934534 | 8/1963 |
| GB | 968698 | 9/1964 |
| GB | 2015350 | 6/1982 |
| GB | 2066795 | 5/1984 |
| GB | 2139903 | 11/1984 |
| GB | 2154451 | 9/1985 |
| GB | 2167735 | 6/1986 |
| GB | 2250017 | 5/1992 |
| GB | 0004210 | 4/2000 |
| GB | 2351729 | 1/2001 |
| GB | 2412114 | 9/2005 |
| GB | 2402347 | 12/2008 |
| JP | 1986244360 | 10/1987 |
| JP | 01313056 | 12/1989 |
| JP | 02144065 | 6/1990 |
| JP | 05084279 | 4/1993 |
| JP | 05115535 | 5/1993 |
| JP | 1999347102 | 12/1999 |
| JP | 2000000288 | 1/2000 |
| JP | 2000135270 | 5/2000 |
| JP | 2000189496 | 7/2000 |
| JP | 2000271193 | 10/2000 |
| JP | 2001009008 | 1/2001 |
| JP | 209271 | 7/2001 |
| JP | 2001187117 | 7/2001 |
| JP | 3209271 | 9/2001 |
| JP | 2001299877 | 10/2001 |
| JP | 2001299878 | 10/2001 |
| JP | 20001299877 | 10/2001 |
| JP | 2002011076 | 1/2002 |
| JP | 2002200144 | 7/2002 |
| JP | 3090241 | 11/2002 |
| JP | 1173123 | 5/2003 |
| JP | 2003144529 | 5/2003 |
| JP | 2003144530 | 5/2003 |
| JP | 2003205018 | 7/2003 |
| JP | 2002306572 | 10/2003 |
| JP | 2004113549 | 4/2004 |
| JP | 2004129940 | 4/2004 |
| JP | 3104866 | 10/2004 |
| JP | 2006006809 | 1/2006 |
| JP | 20066006809 | 1/2006 |
| JP | 2006068360 | 3/2006 |
| KR | 200309862 | 4/2003 |
| KR | 1020040062866 | 7/2004 |
| TW | 235479 | 12/1994 |
| TW | M242210 U | 11/2003 |
| TW | M245977 U | 10/2004 |
| WO | WO9825571 | 6/1999 |
| WO | WO2000050510 | 1/2000 |
| WO | WO2000054726 | 9/2000 |
| WO | WO01/34482 | 5/2001 |
| WO | WO02/074227 | 9/2002 |
| WO | WO2003092577 | 11/2003 |
| WO | WO 2004/013001 | 2/2004 |
| WO | WO2004039304 | 5/2004 |
| WO | WO2004043325 | 5/2004 |
| WO | WO2004064578 | 8/2004 |
| WO | WO2004065247 | 8/2004 |
| WO | WO2005041851 | 5/2005 |
| WO | WO2006011573 | 2/2006 |

OTHER PUBLICATIONS

International Search Report for PCT/GB05/002532 dated Dec. 7, 2005.

International Search Report for PCT/GBOS/00183 dated Aug. 11, 2005.

IP India Examination Report for 5762/DELNP/2011 which is a foreign counterpart application for U.S. Appl. No. 14/551,783, dated Feb. 3, 2018, 4 pages.

Search Report for GB0410993,0 dated May 19, 2005.

Search Report for GB0414560,3 dated Mar. 4, 2005.

Search Report for GB0502599A dated May 6, 2005.

*Comotomo Inc. and Comotomo Corporation*, Petitioner v. *Maybom (UK) limited*, Patent Owner, Case No. IPR2022-01325, U.S. Pat. No. 10,952,930 decision dated Jan. 24, 2023, 31 pages.

*Comotomo Inc. and Comotomo Corporation*, Petitioner v. *Maybom (UK) limited*, Patent Owner, Case No. IPR2022-01326, U.S. Pat. No. 11,207,244 decision dated Jan. 24, 2023, 25 pages.

BABY BOTTLE WITH FLEXIBLE NIPPLE REGIONS

CROSS-REFERENCE TO RELATED APPLICATIONS

This application is a continuation of U.S. application Ser. No. 17/208,932 filed on Mar. 22, 2021, which is a continuation of U.S. application Ser. No. 14/551,783 filed on Nov. 24, 2014, which is a continuation of U.S. application Ser. No. 13/364,557 filed on Feb. 2, 2012, which was a continuation of U.S. application Ser. No. 11/630,864 filed on Sep. 20, 2007, which was a national filing under § 371 of International Application PCT/GB2005/002532, with an international filing date of Jun. 29, 2005, claiming priority from Great Britain Application No. GB2004/14560.3, with a filing date of Jun. 29, 2004, now abandoned, and Great Britain Application No. GB2005/02599.4, with a filing date of Feb. 8, 2005, now abandoned, all of which are herein incorporated by reference.

TECHNICAL FIELD

The invention relates to a drinking vessel with a nipple, in particular a baby bottle having a nipple of increased flexibility and functionality.

BACKGROUND OF THE INVENTION

Various known teats have been designed to mimic the human breast in operation. One known teat is described in U.S. Pat. No. 6,645,228 and includes a stem and a base. The base has a bulbous region and an areola region from which the stem projects. The bulbous region has an upper region with a progressively thinning wall which acts as a spring element such that as an infant sucks on the teat the areola and stem move back and forth relative to the bulbous region.

Various problems arise with this arrangement. Movement of the areola region and stem relative to the bulbous region does not closely mimic the movement of the human breast during sucking. Furthermore because flexibility is provided upon a progressively thinning wall region, the amount of flexing and the point at which flexing takes place is undefined and unpredictable.

A second known teat is described in U.S. Pat. No. 6,745,912 B2 (Pigeon) including a series of parallel annular grooves on the inner surface of the nipple which allows stretching of the nipple but only in a constrained direction, and with the risk of flow blockage if the nipple collapses.

In addition, efforts are continuing to provide valved feeding bottles, in particular to allow air ingress to the teat. It is believed that this reduces the risk of colic which can otherwise occur as a result of negative pressure building up in the feeding bottle. Various known arrangements include slit valves of various types, however these are frail and difficult to machine. In another approach described in German patent DE19716535 a teat is provided with an inner annular resilient flange at its base which rests on a bottle rim when screwed down by a collar. Upon a negative pressure building up inside the drinking vessel the flange lifts from the vessel rim and air passes up through the collar and between the flange and the vessel rim.

In a similar arrangement described in European patent application EP151862 a teat includes a downwardly depending cylindrical flange at its base which seals against the inner top face of a vessel neck when deformed by being screwed down by a collar. Again a negative pressure inside the vessel lifts the flange away from the vessel neck so that air flows through the collar and between the neck and the flange into the vessel to relieve the pressure differential. Such arrangements rely on the correct amount of screw pressure being applied by the user on fixing the teat which can give rise to varied levels of valving between uses. Furthermore the introduction of a circumferential flange increases material costs.

SUMMARY OF THE INVENTION

The invention is set out in the claims. According to a first embodiment, because the flex region is provided in the areola portion allowing the teat portion and/or areola portion to move towards and away from one another a more natural feeding action is provided. Furthermore, because of the inclusion of a plurality of flex channels the point of flexure is clearly defined. According to a second embodiment, because of the provision of a helical flow formation on the inner face of the teat, continuous flow of liquid is allowed even when the teat collapses via the helical flow path while allowing extension of the teat and in particular a rotational or torsional extension. It will be understood that each of the terms "teat" and "nipple" embraces feeding bottle teats and nipples as well as soother teats and nipples, sometimes known as "baglets".

Embodiments of the invention will now be described by way of example with reference to the drawings.

DETAILED DESCRIPTION OF THE INVENTION

Figure 1:
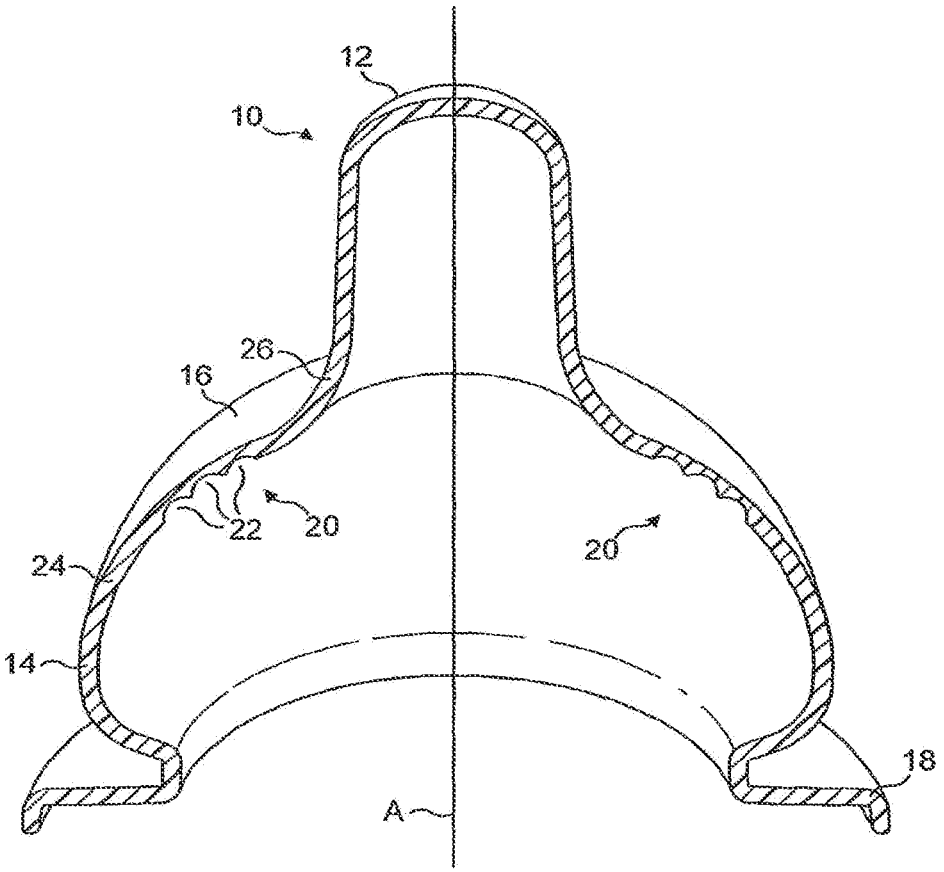
FIG. 1 is a cross-sectional side view of a teat according to the present invention.

Referring firstly to FIG. 1 a teat 10 for use with a feeding bottle includes a teat portion 12, a base portion 14 and an areola portion 16 therebetween. A flange 18 extends from the base of the base portion to allow fixing to a feeding bottle (not shown) in any appropriate known manner. The base portion may also include a one-way air-inlet valve of any appropriate type for example an integrally moulded duckbill valve (not shown). The teat has circular symmetry around an axis A running through the center of the teat.

The areola portion 16 includes a flex region 20 comprising three grooves or flex channels 22 extending around an inner surface of the areola portion effectively forming circular thinned regions parallel/concentric with each other about the axis A and hence surrounding the teat portion. The flex region 20 is generally provided between a transition region 24 separating the base portion 14 and the areola portion 16 and a transition region 26 separating the areola portion 16 and the teat portion 12. The flex region 20 allows flexing of the teat as described in more detail below.

The teat can be formed in any appropriate manner, for example compression or injection moulding and formed of any appropriate elastic material such as silicone, latex or thermoplastic elastomer (TPE). Injection moulded silicone provides a particularly desirable degree of elasticity in the teat portion. The teat portion 12 is preferably thinner in cross-section than the remainder of the teat or is co-moulded with a more flexible material to allow additional flexing of the teat portion relative to the teat as a whole. The teat can have a texture such as a skin-like texture moulded or otherwise patterned on to its surface.

Figure 2A:
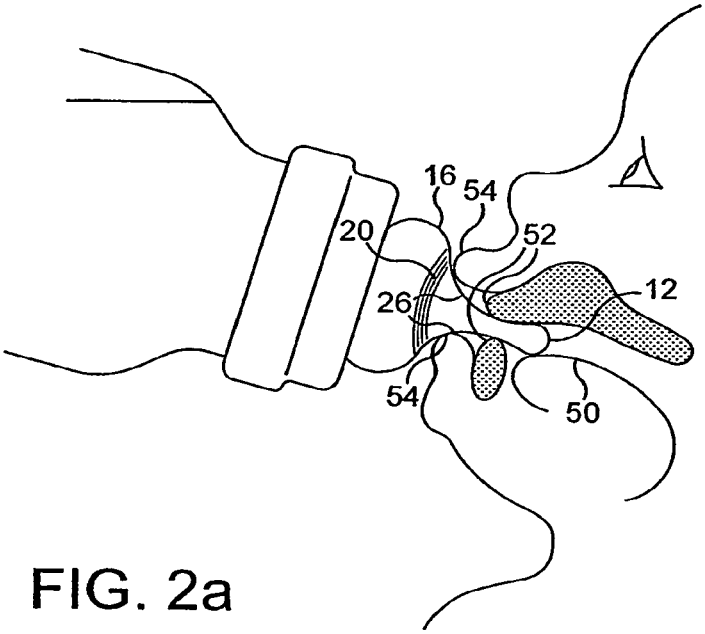
FIG. 2*a* is a side view of the teat of FIG. 1 in use in a first flexed position.
Figure 2B:
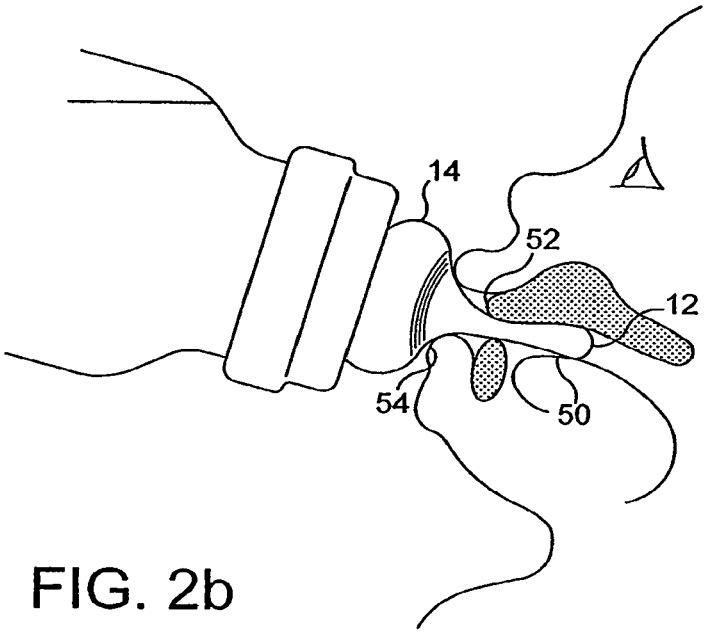
FIG. 2*b* is a side view of the teat of FIG. 1 in use in a second flexed position.

As shown in FIGS. 2*a* and 2*b*, in operation an infant drinks from the teat mounted on a bottle, the infant's tongue 50 contacting the teat portion 12, the infant's teeth or gums 52 contacting the transition portion 26 and the infant's lips 54 contacting the areola portion 16 generally at the flex region 20. As a result, as the infant sucks on the teat, the teat portion and areola portion flex towards and away from one another by virtue of respective collapsing and extending of the flex region around the flexed channels 22. In particular, as can be seen in FIG. 2*a*, reduced suction on the teat portion 12 towards the base portion 14 relaxes the flexible reduced suction whereas, as shown in FIG. 2*b*, suction on the teat portion 12 away from the base portion 14 collapses the flexible region 20 extending the teat portion and areola portion away from one another.

The back and forth motion of the teat portion 12 mimics very closely the natural movement of the human breast during suckling or sucking of the infant by effectively allowing the teat to move and stretch as skin moves and stretches. The grooves or channels further visually define an areola area and are placed at an area of the teat which is also a non-bite area. The flexible portion also provides a pumping action on liquid in the bottle as the teat portion oscillates or reciprocates back and forth.

Figure 3A:
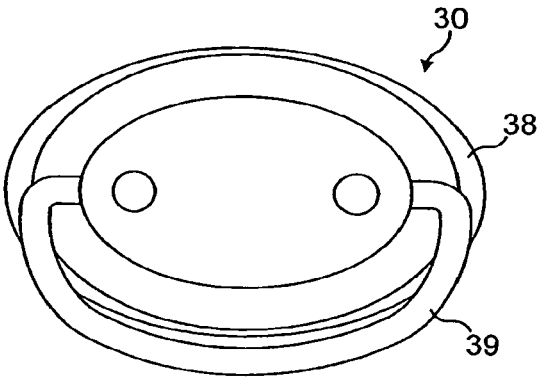
FIGS. 3*a* and 3*b* are end and side views respectively of a soother incorporating the teat of the present invention.
Figure 3B:
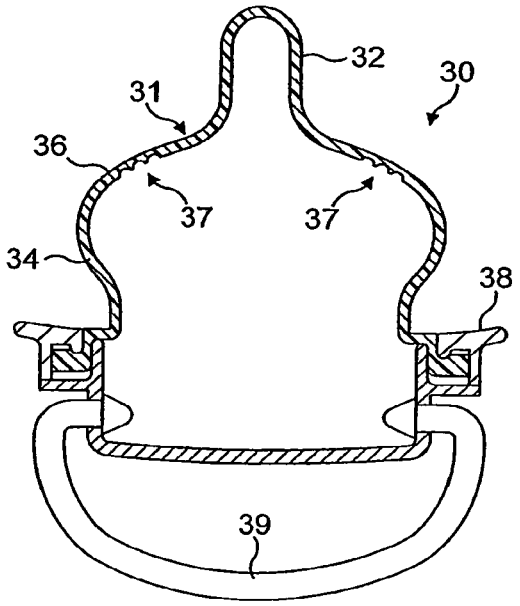

FIGS. 3*a* and 3*b* show a soother 30 employing a teat or baglet 31 according to the first embodiment of the present invention. The teat 31 includes a teat portion 32, a base portion 34 and an areola portion 36 therebetween. The teat 31 is generally hollow and is secured at the base portion 34 to a shield 38, having a ring or handle 39, with the areola portion 36 forming a non-bite portion of the teat 31. A flex region 37, is situated at the non-bite areola portion 36, and comprises grooves or channels extending around the inner surface of the teat 31 at the areola portion 36. As an infant sucks on the teat 31, the teat portion 32 flexes back and forth as a result of the respective collapsing and extending of the flex region 37 grooves. As before, this back and forth movement mimics the movement of a human breast during suckling, but with the flex region in a non-bite area.

Figure 4:
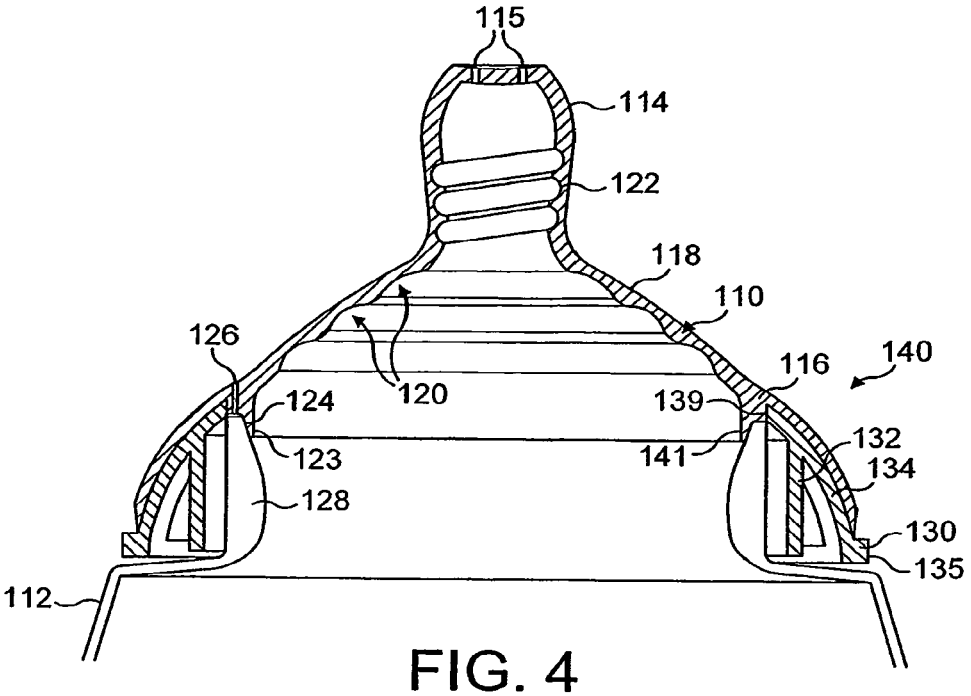
FIG. 4 is a cross-sectional side view of a teat and vessel according to another aspect of the present invention.

Referring to FIG. 4, it will be seen that according to another aspect a teat assembly 140 is mounted on an infant drinking vessel 112. The teat assembly 140 includes a teat 110 having a teat portion 114 forming a nipple having drink apertures 115 at its upper end, a base portion 116 mountable to the drinking vessel and an areola region 118 therebetween. The teat 110 is textured and shaped to mimic the human breast and can, for example have skin-like texture varying between the teat portion, areola region and base portion, similar to the human breast. The teat can indeed be coloured to mirror human skin colour including ethnic skin colours. The shape of the teat is also similar to the human breast, the base portion 116 being shaped like a breast and having a wide, domed configuration. The areola portion 118 rises from the base portion 116 to the teat portion 114 at an angle to the horizontal, that is to say, with a component of inclination parallel to the teat portion 114, allowing better pursing by the infant so that they can close their lips effectively around the teat, and again mimicking the human breast such that the experience of the infant is as similar as possible to the natural experience of breast feeding.

The teat 110 is formed from an elastomer with walls of decreasing thickness from the base portion 116 through to the teat 114 providing a more realistic flexing characteristic. The areola portion 118 further includes undulating grooves 120 forming, in cross-section, a wavy profile on the inner surface of the areola portion 118 and extending circumferentially. In the embodiments shown three such grooves are formed adjacent one another providing a bellows action as well as flexing in a direction perpendicular to the flow direction and increasing the flexibility especially in conjunction with the decreasing wall thickness providing a more natural stretching characteristic and sensory feedback to the infant. Yet further, the teat can be textured on its outer and/or inner surface to enhance operation or realism of the teat as appropriate.

The teat portion 114 projects generally perpendicular to the mouth of the vessel 112 and is elongate for example of length 20 mm, again to mimic the extension of the human nipple during breast feeding. The teat portion has a generally rectangular cross-section with wall thickness 1.8 mm and diameter 13 mm. A tight pitch helical groove 122 of groove depth 0.9 mm (half the wall thickness) having for example three turns and 3 mm pitch is moulded or otherwise formed around the inner cylindrical vertical surface of the teat portion 114 to form a flow passage even when the teat portion is collapsed, for example under biting pressure from an infant. In addition the helical groove allows rotational or torsional compression and extension of the teat portion in the range of 5-6 mm and flexing parallel perpendicular to the flow direction, again more closely mimicking the human breast.

Figure 5A:
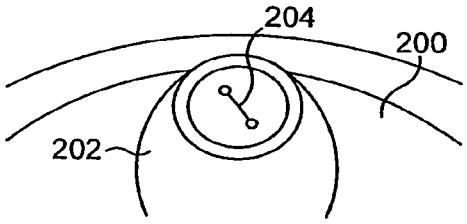
FIG. 5*a* is a perspective view showing a teat valve in a first, closed configuration.
Figure 5B:
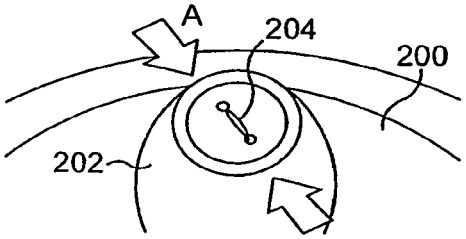
FIG. 5*b* is a perspective view showing a teat valve in a second, open configuration.

At the tip of the teat portion the apertures 115 comprise a variable flow valve, where the flow can either be selected by choosing a teat with appropriate apertures or a two or three crossed slit configuration can be provided allowing the infant to regulate flow. For example referring to FIGS. 5*a* and 5*b*, a teat 200 includes a teat portion 202 with a slit valve 204. As can be seen from FIG. 5*b* when pressure is applied in the longitudinal direction of the slit, for example bite pressure, the slit valve opens allowing fluid flow by application of compression and distortion pressure.

The teat assembly 140 is formed in a two-shot moulding process with elastomer forming the teat 110 and polypropylene forming a screw collar 130 which is integrally formed with the teat 110. As a result a resilient, cheaply and easily manufactured integral assembly is provided.

The screw collar 130 includes an internally threaded cylindrical portion 132 and a downwardly domed peripheral portion 134 surrounding it and extending from an upper end of the cylindrical portion 132. The domed portion 134 includes a horizontal outward annular flange 135 of thicker cross-section at its base. The teat 110 is over-moulded onto the screw collar 130 and the domed portion 134 terminates at a central circular orifice corresponding with an outer face of the neck 128 of the vessel 112, the over-moulded portion of the teat extending inwardly slightly from this position and terminating in a downwardly depending cylindrical flange 141.

As a result the screw collar provides structural strength and a strong screw fit, but the resilient material of the teat portion 140 provides sealing. In particular the threaded cylindrical portion 132 of the screw collar screws on to the outwardly threaded neck 128 of the vessel 112 and the top, innermost edge of the domed portion 134 abuts the outer face of the neck 128. Because the teat material 110 overhangs the inner edge 139 of the domed portion 134, when the teat assembly 140 is screwed down, the overhanging portion seals against the top rim of the neck 128 and the downward cylindrical flange 141 forms an elastomer sealing ring sealing against the top inner face of the vessel neck 128. The teat 110 includes a vent passage 126 through the elastomer material and substantially at the periphery. A discontinuous flap or lip valve portion 123 projects down from the flange 141 in a portion of the periphery only in the vicinity of the vent passage 126.

Figure 6:
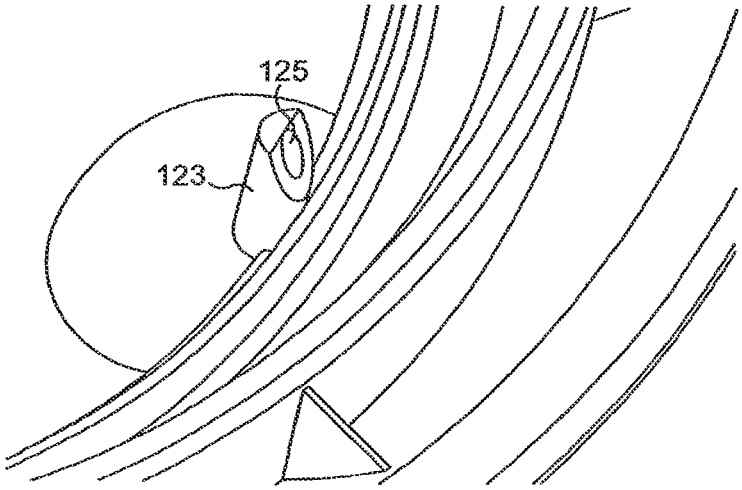
FIG. 6 is a partial perspective view of the underside of the teat, showing a lip valve.

Because of the resilience of the flange portion, when an infant sucks on the teat, reducing pressure within the vessel, the lip valve 123 will flex away from the neck 128 of the vessel 112. In the region of the vent 126 in the teat 110, this allows venting between the interior of the vessel and atmosphere through the teat. Referring to FIG. 6 the lip valve 123 can be seen viewed from the underside. In the embodiment shown it will be seen that a passage 125 actually passes through the lip valve, communicating with the vent passage 126. In that case the aperture to the passage 125 will seal against the inner face of the vessel in the sealed configuration and unseal to provide a passage.

Alternatively a slit valve 124 can comprise a flap which flexes away from the interior surface to allow communication with a vent passage as described above.

Figure 7A:
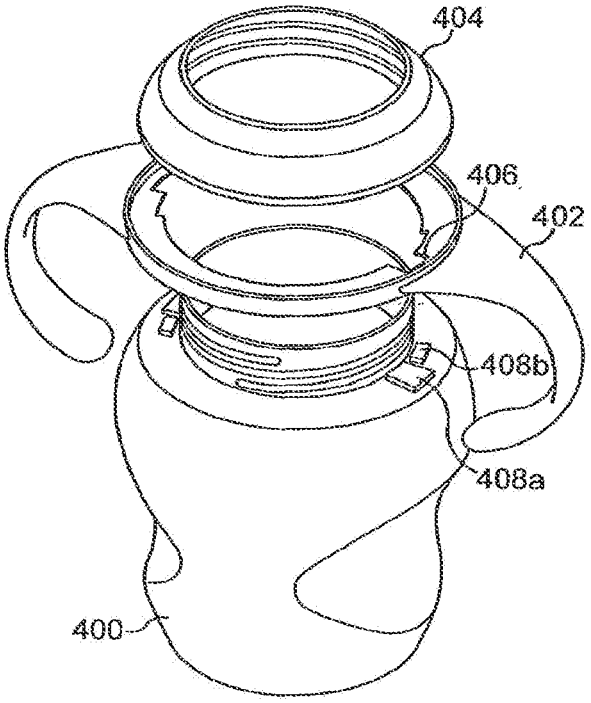
FIG. 7*a* is an exploded perspective view showing assembly steps for a drinking vessel according to the invention.
Figure 7B:
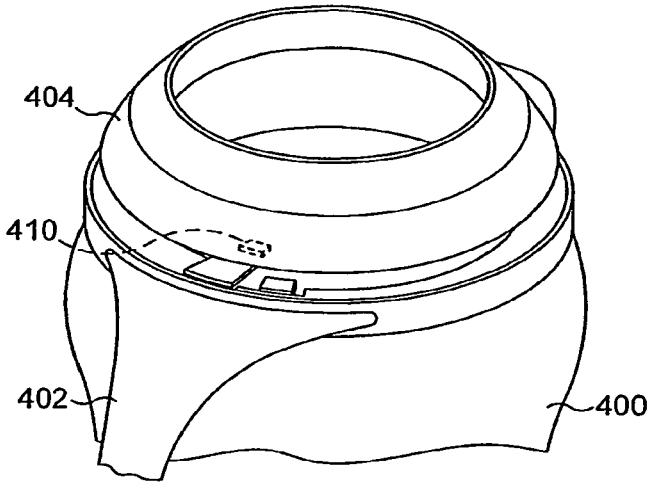
FIG. 7*b* is a perspective view showing a first detail of an assembled vessel according to the present invention.
Figure 7C:
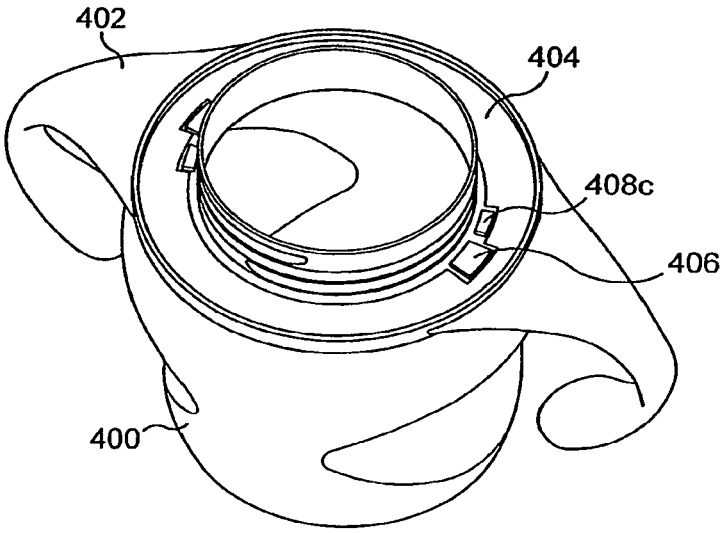
FIG. 7*c* is a perspective view showing a second detail of an assembled vessel according to the present invention.

The teat assembly 140 also has a positive engagement stop providing tactile feedback to ensure that the teat assembly is correctly tightened on the vessel and allows the lip valve to seal effectively. Referring to FIGS. 7*a* to 7*c*, for example, it will be seen that a vessel 400 receives a handle portion 402 and a teat screw collar 404, corresponding to the screw collar 130 described above but with the elastomer teat 10 removed for the purposes of clarity of understanding.

The handle portion 402 includes a cut-out portion 406 which cooperates with projections 408*a*, 408*b* on the vessel to locate the handle portion in a predetermined position. The handle portion is placed over the vessel and located in the desired orientation and then the collar 404, including an internal thread portion allowing mounting on the vessel 400 is screwed into position as described above, securing the handle portion 402 in place.

As can best be seen in FIG. 7*b*, the collar portion 404 includes an internal lug 410 which projects inwardly from the inner face and engages against a stop feature on the screw threaded portion of the vessel 400 formed by the projections 408*a*, 408*b* such that the teat 110 "clicks" into a desired position. As a result a controlled compression on the lip valve 123 is obtained such that a consistent and repeatable valving action is obtained on each use. In particular the projections 408*a*, 408*b* are separated by a recess, 408*c* best seen in FIG. 7*c*. When the collar 404 is screwed into place the lug 410 passes over the projection 408*b* which has a ramp towards the recess 408*c*. After the lug 410 has ridden up the ramp it drops into the recess 408*c* and is obstructed from further movement by the planar face of the projection 408*a*. The lug 410 further prevents the collar 404 from being unscrewed by virtue of its engagement with the abutting face of the projection 408*b*. However the lug 410 and projection 408*b* have chamfered or radiused abutting faces such that, on application of sufficient unscrewing pressure, the lug 410 rides over the chamfered face of the projection 408*b* and then down the ramp allowing the collar to be fully unscrewed.

In operation the vessel is filled with drinking liquid and the teat assembly 140 is screwed on until positive engagement is detected (for example a discernable "click") meaning that it is correctly fitted. When the infant then drinks from the vessel the pressure difference pulls the lip valve 123 away from the inner face of the neck 128 of the vessel 112 allowing venting through vent passage 126 and hence reducing the risk of colic. Because of the provision of the lip valve there is no requirement for providing slits and a natural, robust and resilient valve assembly is provided. Furthermore, the valve is formed during the moulding operation and requires no secondary operation for its formation providing commercial and manufacturing benefits. Yet further as a single vent passage is provided at one point on the teat, the risk of leakage is reduced, especially as the vent passes through the teat rather than around the vessel neck.

It will be appreciated that the teat can be formed of any material and can be any appropriate shape which may be, for example, non-symmetrical such as a shaped or orthodontic teat or even more closely mimicking the shape of the human breast. Different teat configurations can be provided to grow with different ages of infant. For example the teat portion can be made progressively longer as the age of the infant who will be using the teat increases and/or the texture can be made less prominent, for example ranging from coarse for new-borns through fine to gloss.

In the teat of the first embodiment, the flex channels in the flex region can be of any appropriate profile for example square, semi-circular or triangular in cross-section and can be provided on the inner or outer surface of the teat and in any appropriate number. Instead of providing thinned regions the flexed channels can be formed by a concertina or bellows configurations moulded into the teat or any other appropriate hinge or fold mechanism. Furthermore features of either the first or second embodiment can be interchanged or juxtaposed with one another or implemented in other types of drinking vessel cover as appropriate. For example the lip valve can be implemented in a trainer cup cover, a sports bottle or other vessel closures capable of forming a partial vacuum in a vessel in use.

It will be appreciated that whilst the Figures show a soother comprising a teat of the first embodiment, the invention also encompasses a soother comprising a teat of the second embodiment. The soother comprising the teat and shield/ring components can be formed from any appropriate material. For example, the teat can be formed from silicone, latex or Thermoplastic Elastomer (TPE), whilst the shield and ring can be formed from thermoplastic materials such as polypropylene PP, polycarbonate PC or similar material blends as appropriate. Furthermore, the soother can be manufactured by any appropriate moulding method.

What is claimed is:

1. A baby bottle, comprising:

a vessel with an opening comprising a rim; and an assembly configured to mount and seal over the vessel comprising:

a collar configured to removably couple to a nipple and mount over the vessel opening; and a nipple having a teat with an aperture, a base, an areola portion between the teat and the base, and a flange configured to seal over the vessel rim, i. wherein the flange extends from a substantially cylindrical lower portion of the base to define the outermost nipple circumference, and ii. wherein an air vent projects internally into the nipple interior below the teat, and wherein the nipple and collar together define a breast shape comprising a teat projecting from a domed configuration that extends outwardly and downwardly to a widest circumferential edge of the collar.

2. The baby bottle of claim 1, wherein the vessel has varying internal circumference and comprises a threaded upper portion, a middle portion below the upper portion, and a bottom portion below the middle portion.

3. The baby bottle of claim 2, wherein the middle portion is tapered inward.

4. The baby bottle of claim 2, wherein the internal circumference of the vessel increases from the bottom portion toward the opening.

5. The baby bottle of claim 2, wherein the middle portion of the vessel comprises two indentations.

6. The baby bottle of claim 1, wherein the areola portion comprises a flex region configured to allow the teat to flex towards and away from the areola portion.

7. The baby bottle of claim 6, wherein the flex region further comprises a molded groove in the inward facing surface of the nipple.

8. The baby bottle of claim 6, wherein the flex region further comprises a bellows configurations molded into the inward facing surface of the nipple.

9. The baby bottle of claim 6, wherein the flex region further comprises regions of alternating nipple thickness.

10. The baby bottle of claim 1, wherein the air vent is an integrally molded duckbill valve.

11. The baby bottle of claim 1, wherein an outer surface of the nipple is textured.

12. The baby bottle of claim 1, wherein the aperture comprises a variable flow valve.

13. The baby bottle of claim 1, wherein the teat comprises multiple apertures.

14. The baby bottle of claim 1, wherein the collar comprises a horizontal outward annular flange.

15. The baby bottle of claim 1, wherein the flange comprises a downwardly extending skirt around its circumference.

16. A baby bottle, comprising:

a vessel with an opening comprising a rim; and an assembly configured to mount and seal over the vessel comprising:

a collar configured to removably couple to a nipple and mount over the vessel opening; and a nipple having a teat with an aperture, a base, an areola portion between the teat and the base, and a flange configured to seal over the vessel rim, i. wherein the flange extends from a lower portion of the base to define the outermost nipple circumference, and ii. wherein an air vent projects internally into the nipple interior below the teat, and wherein the nipple and collar together define a breast shape having a domed configuration extending from the teat outwardly and downwardly to a widest circumferential edge of the collar.

17. The baby bottle of claim 16, wherein the nipple and collar when coupled together comprise a seamless contiguous surface.

18. The baby bottle of claim 16, wherein the vessel has varying internal circumference and comprises a threaded upper portion.

19. The baby bottle of claim 16, wherein the areola portion comprises a flex region configured to allow the teat to flex towards and away from the areola portion.

20. The baby bottle of claim 19, wherein the flex region further comprises regions of alternating nipple thickness.

21. The baby bottle of claim 16, wherein the aperture comprises a variable flow valve.

22. The baby bottle of claim 16, wherein the teat comprises multiple apertures.

23. The baby bottle of claim 16, wherein the air vent is an integrally molded slit valve.

24. A baby bottle, comprising:

a vessel with an opening comprising a rim; and an assembly configured to mount and seal over the vessel comprising:

a collar configured to removably couple to a nipple and mount over the vessel opening; and a nipple having a teat with an aperture, a base, an areola portion between the teat and the base, and a flange, i. wherein the flange extends circumferentially from a lower portion of the base to seal over the vessel rim, and ii. wherein an air vent projects internally into the nipple interior below the teat, and wherein the nipple and collar together define a wide circular breast shape having a domed configuration extending outwardly and downwardly from the teat to a circumferential edge of the collar.

25. The baby bottle of claim 24, wherein the areola portion comprises a flex region comprising regions of alternating nipple thickness.

26. The baby bottle of claim 25, wherein the flange comprises a downwardly extending skirt around its circumference.

27. The baby bottle of claim 24, wherein the regions of alternating nipple thickness are horizontal and perpendicular to the axis of the teat.

28. The baby bottle of claim 24, wherein the nipple and collar when coupled together comprise a seamless contiguous surface.

29. The baby bottle of claim 24, wherein the air vent is an integrally molded duckbill valve.

30. The baby bottle of claim 29, wherein the air vent projects downwardly into the interior of the teat.

* * * * *